US005607019A

United States Patent [19]

Kent

[11] Patent Number: 5,607,019

[45] Date of Patent: Mar. 4, 1997

[54] ADJUSTABLE MANDREL HANGER FOR A JACKUP DRILLING RIG

[75] Inventor: Peter M. Kent, Warthill, Scotland

[73] Assignee: Abb Vetco Gray Inc., Houston, Tex.

[21] Appl. No.: 526,727

[22] Filed: Sep. 11, 1995

Related U.S. Application Data

[63] Continuation-in-part of Ser. No. 419,347, Apr. 10, 1995.

[51] Int. Cl.[6] ..... E21B 33/043

[52] U.S. Cl. ..... 166/344; 166/95.1; 166/382

[58] Field of Search ..... 166/342, 344, 166/348, 95.1, 368, 382

[56] References Cited

U.S. PATENT DOCUMENTS

| | | | |
|---|---|---|---|
| 4,651,831 | 3/1987 | Baugh | 166/344 |
| 4,781,387 | 11/1988 | Baugh | 166/348 X |
| 4,909,546 | 3/1990 | Nobileau . | |
| 4,938,289 | 7/1990 | Van Bilderbeek | 166/342 |
| 4,949,786 | 8/1990 | Eckert et al. . | |
| 4,979,566 | 12/1990 | Hosie et al. . | |
| 4,995,464 | 2/1991 | Watkins et al. . | |
| 5,002,131 | 3/1991 | Cromar et al. . | |
| 5,127,478 | 7/1992 | Miller | 166/348 |
| 5,148,870 | 9/1992 | Fernandez et al. | 166/344 |
| 5,240,076 | 8/1993 | Cromar et al. . | |
| 5,240,081 | 8/1993 | Milberger et al. | 175/8 |
| 5,255,746 | 10/1993 | Bridges . | |
| 5,311,947 | 5/1994 | Kent et al. . | |
| 5,439,061 | 8/1995 | Brammer et al. . | |

OTHER PUBLICATIONS

S/N 08/285,577 Filed Aug. 3, 1994.
Drawing D600166–16.

*Primary Examiner*—Frank Tsay
*Attorney, Agent, or Firm*—James E. Bradley

[57] ABSTRACT

An offshore well system for a jackup drilling rig enables tensioning of the upper casing strings. An upper running tool is secured to a mandrel, which in turn is connected to the upper casing string. A locking member is located on the mandrel and lands on an internal shoulder in the surface wellhead while the upper string is being lowered by the upper running tool through the surface wellhead. The locking member has a cocked position which allows further downward movement of the mandrel after the locking member has landed on the internal shoulder. A torque member connected between the upper running tool and the mandrel allows left-hand rotation of the upper casing string without risk of the upper running tool unscrewing from the mandrel. This exposes wash ports for circulating fluid back up the annulus around the upper casing string. Flow passages in the locking member allows cement returns and circulation during washout operations after the locking member has landed on the internal shoulder. The locking member is released from the cocked position to a weight supporting position by moving an actuating sleeve upward. The upward movement of the actuating sleeve also frees the torque member to move to a released position. This enables the upper running tool to be unscrewed from the mandrel at the conclusion of the operation.

24 Claims, 6 Drawing Sheets

ADJUSTABLE MANDREL HANGER FOR A JACKUP DRILLING RIG

CROSS-REFERENCE TO RELATED APPLICATION

This application is a continuation-in-part of application Ser. No. 08/419,347, filed Apr. 10, 1995, Adjustable Mandrel Hanger System.

BACKGROUND OF THE INVENTION

1. Field of the Invention

This invention relates in general to a system for tensioning a string of casing extending between a subsea wellhead and a surface wellhead located on a jackup drilling rig, and in particular to a system utilizing an adjustable mandrel.

2. Description of the Prior Art

Offshore wells may be drilled by floating drilling vessels, or if the water isn't too deep, by jackup drilling rigs. In a jackup drilling rig, the legs of the rig are adjustable in length to support the rig on the ocean floor. The well will have a subsea wellhead assembly located on the sea floor.

In a common subsea wellhead assembly, called a mudline suspension system, the rig will drill to a first depth and install large diameter conductor pipe. The conductor pipe extends to the rig where a surface wellhead will be installed. The surface wellhead is located on a well deck generally about 90 feet below the rig floor but above the water. The operator will then drill to a second depth and install a string of outer casing. The operator drills to a third depth, installs intermediate casing, and then to a fourth depth, installing inner casing. In some cases, an even smaller diameter string of casing may be installed within the inner casing.

In a mudline suspension system, each string of casing has a lower section which extends from the subsea wellhead downward into the well and an upper section which extends from the subsea wellhead to the drilling rig. Each string has a casing hanger located at the upper end of the lower casing string which lands in the previously installed casing string. Each string has lower running tool which connects the lower end of the upper casing string to the hanger.

In a mudline hanger system, seals are not employed between the various strings of casing at the subsea wellhead. Rather, sealing between the various strings of casing is handled at the surface wellhead. When running the various strings of casing, the lower casing strings will be cemented in place. Each casing hanger and its running tool have a number of wash ports. The wash ports are used to circulate fluid down the upper string of casing, through the wash ports at the hanger level, then back up the annulus surrounding the upper casing string to wash the annulus at the casing hanger free of any cement. The wash ports of the intermediate and inner hangers are opened by partially unscrewing the running tool from the hanger after the lower casing string has been cemented. This requires opposite direction rotation, which is normally left-hand rotation. The mating threads between the running tools and their hangers readily allow left-hand rotation without unscrewing any of the sections of the upper string of casing.

It is desirable to support the upper strings of casing between the subsea and surface wellheads in tension. This may be accomplished with a locking member at the surface wellhead. There are various types of locking members, but each is axially moveable relative to the casing and lands on an internal shoulder in the surface wellhead. Tension is applied to the upper strings of casing during each installation, and the locking member is positioned to hold the tension in the upper casing string. Prior art types of locking members include both threaded rings which are rotated into position, and ratchet-type rings which are moved axially without rotation.

In the prior art tensioning techniques, the operator pulls tension with the drilling rig elevators, then moves the locking member into place on the load shoulder. The locking member will be spaced above the load shoulder during cementing and washing out, and therefore clearances exist to allow circulation up the annulus past the locking member. Previously, the locking member could not be landed on the internal shoulder and held in position while applying tension, because the engagement of the lock ring with the internal shoulder blocks flowby for cementing and washout.

In one prior art type which employs a ratcheting locking member, an upper running tool secures to a mandrel-type casing hanger which has exterior grooves engaged by the locking member. In this type, after the locking member has been ratcheted into place on the internal shoulder, the upper running tool is rotated to the left to unscrew it from the mandrel for subsequent operations. It is important to prevent the mandrel and upper running tool from unscrewing while the lower running tool is being unscrewed to expose the wash ports. To prevent inadvertent releasing of the upper running tool while opening the wash ports, in one prior art type, torque fingers are mounted to the upper running tool. Each torque finger has a lower end that engages a torque slot formed in the mandrel. The lower ends are radially expandable, allowing them to spring out of engagement with the slots when the operator later wishes to disengage the upper running tool from the mandrel.

In this prior art type, the ratchet ring was moved downward onto the internal shoulder after cementing and washout operations were completed. Prior to installing the ratchet ring on the internal shoulder, the ratchet ring was held in an upper position surrounding the torque fingers. This upper position of the ratchet ring prevented the torque fingers from moving to the outer position until the washout had been completed. It was not possible to land the ratchet ring on the internal shoulder before cementing, because this would result in the torque fingers releasing from the upper running tool before the washout operation occurred. Because of this reason and the need for circulation flowby discussed above, the prior art ratchet-type mandrel hangers required landing of the ratchet ring after cementing.

SUMMARY OF THE INVENTION

In this invention, an adjustable mandrel hanger with a ratchet ring is employed. Unlike the prior art, the locking member or ratchet ring lands on the internal load shoulder of the casing hanger while the upper and lower strings of casing are being lowered into the well. The locking member is maintained on the load shoulder continuously by an actuating member which is a part of the running tool. The actuating member will hold the locking member in a cocked position, which allows the mandrel and casing strings to move further downward after the locking member has landed on the internal shoulder. This allows the mudline casing hanger to be latched into the profile in the subsea wellhead.

Torque slots are formed on the exterior of the mandrel. A plurality of torque fingers are mounted to the upper running tool for engaging the torque slots to transmit opposite direction rotation of the upper running tool to the upper casing string. The opposite direction is the direction opposite to the direction of make-up of the upper casing string, and is normally left-hand. This causes the lower running tool to move upward to expose the wash ports. The actuating member maintains the torque fingers in the engaged position while simultaneously holding the locking member on the internal shoulder.

The locking member has flowby slots formed through it. This allows circulation up the annulus surrounding the upper casing string during cementing and washout operations. After the washout operation has been completed and the lower running tool moved back down to close the wash ports, the operator pulls upward on the upper running tool to apply tension to the casing. While pulling upward, the actuating member continues to bear against the locking member to prevent it from moving upward from the internal shoulder. After the desired amount of tension has been pulled, the actuating member is stroked upward by hydraulic pressure. The upward movement of the actuating member moves the locking member from the cocked position to a weight supporting position. Simultaneously, the actuating member allows the torque fingers to spring out to the released position. The operator then slacks off the pull on the running tool, causing the locking member to support the upper string in tension. The operator then rotates to the left to unscrew the upper running tool from the mandrel.

DETAILED DESCRIPTION OF THE INVENTION

Figure 1A:
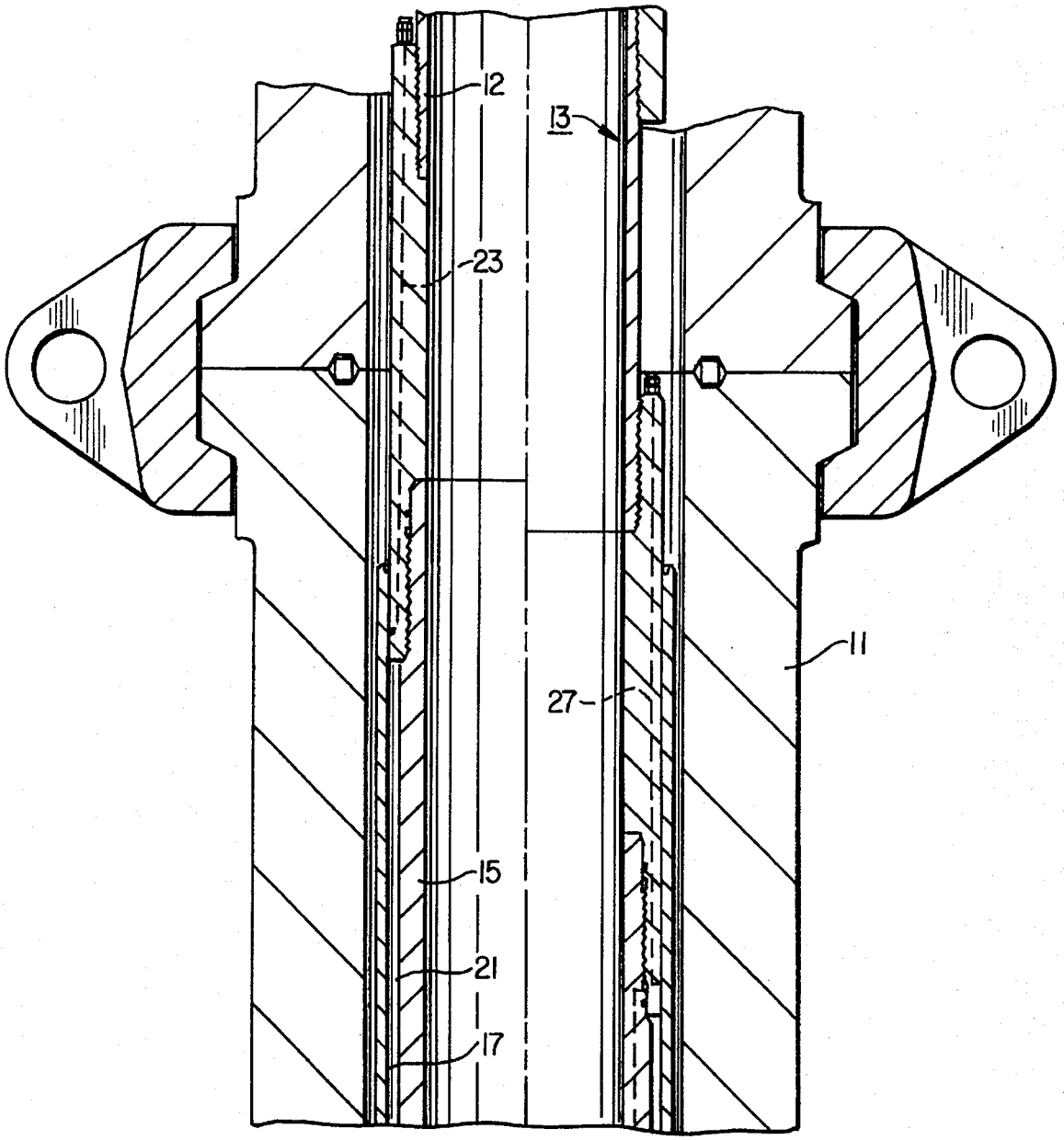
FIGS. 1A, 1B, and 1C make up a vertical sectional view illustrating the surface components of an apparatus constructed in accordance with this invention, with FIG. 1C being of larger scale than FIGS. 1A and 1B. The left side of each drawing shows the apparatus in one position, while the right side shows the apparatus in another position.

Referring to FIG. 1A, drilling riser 11 is part of a blowout preventer stack that extends from a rig floor of a jackup drilling rig (not shown) to a well deck (not shown) about 90 feet below. An upper running tool 13 is shown being lowered on a string of conduit 12 through riser 11. Upper running tool 13 has an inner barrel 15 which secures to conduit 12 and an outer actuating sleeve 17 which moves axially relative to barrel 15. An upper piston 19 (FIG. 1B) is formed on the inner diameter of actuating sleeve 17 in sliding engagement with the exterior of barrel 15 to provide an upper hydraulic fluid chamber 21. An upper hydraulic fluid passage 23 will supply hydraulic fluid to upper chamber 21 to cause the piston 19 and actuating sleeve 17 to move downward relative to barrel 15.

Figure 1B:
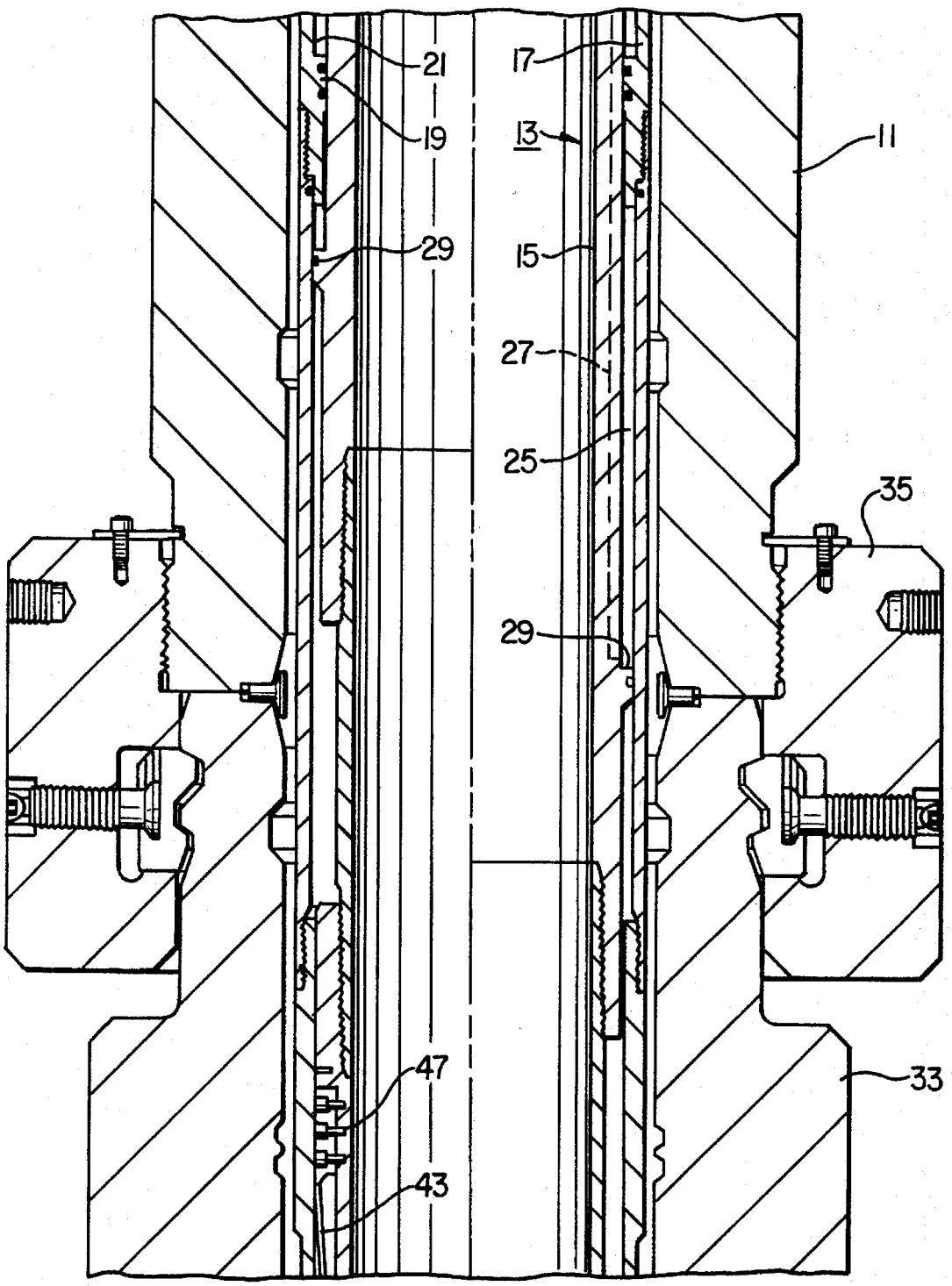
Figure 1C:
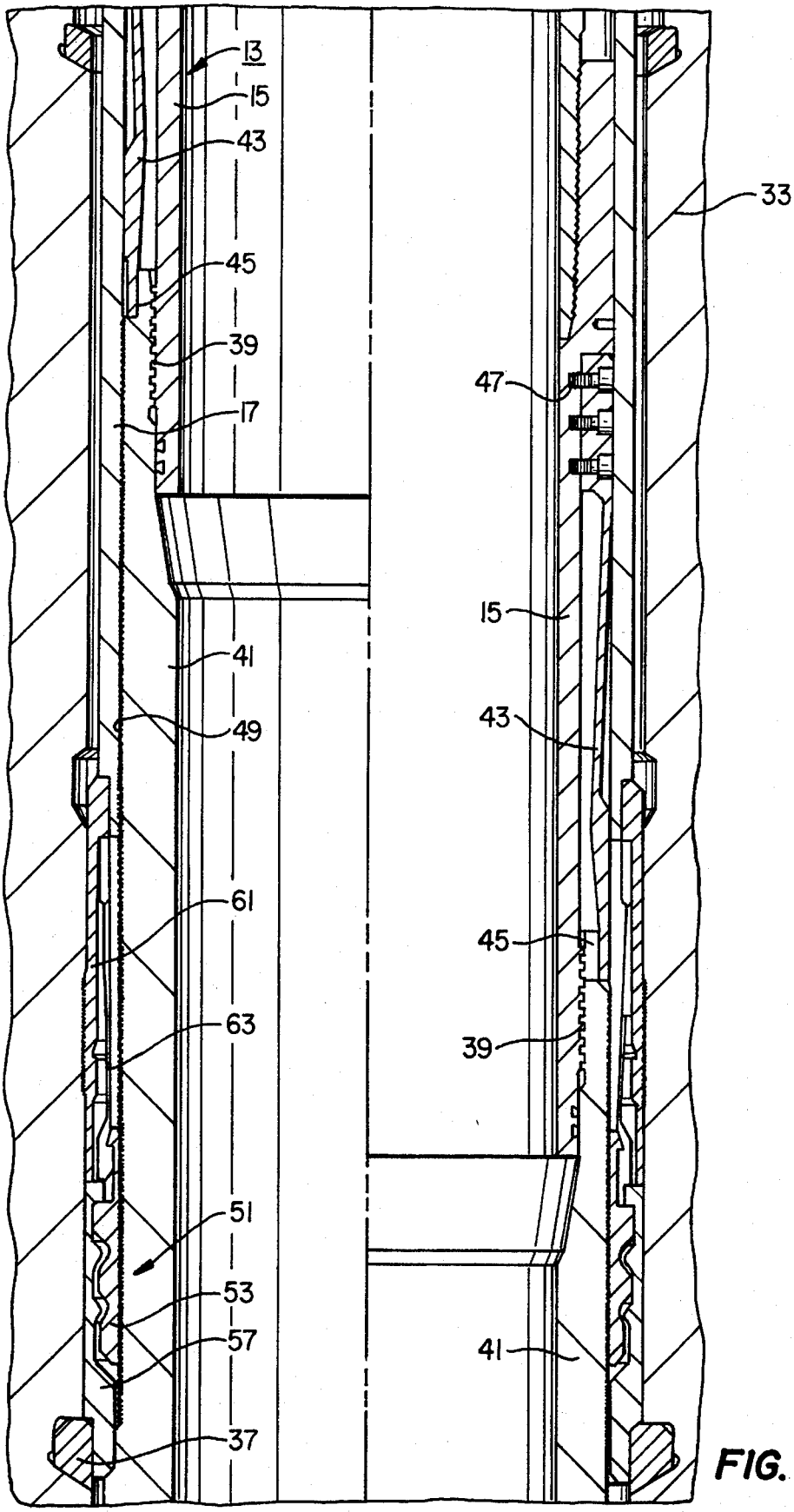
Figure 4:
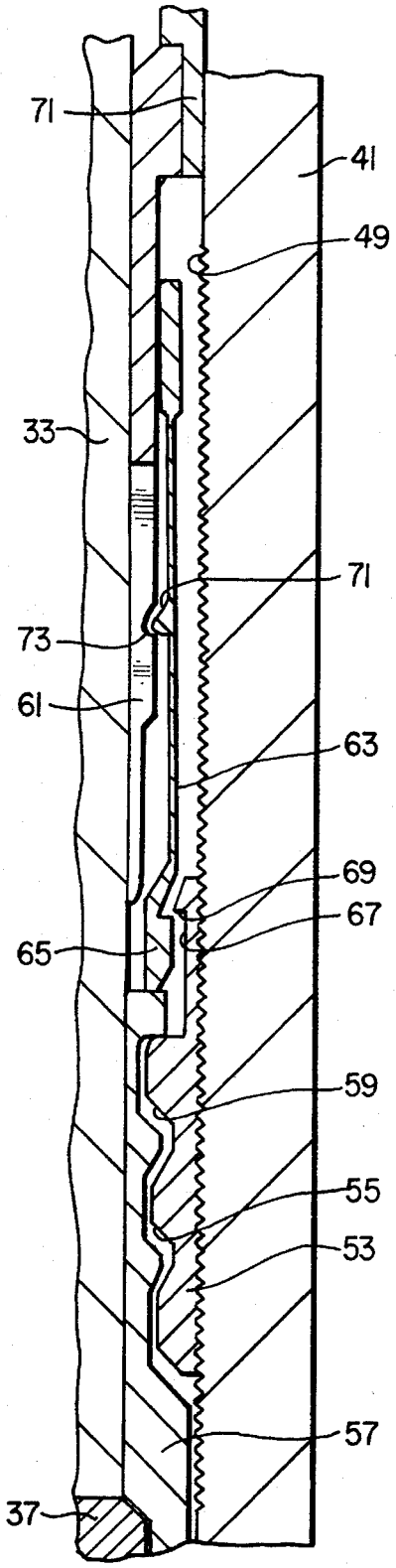
FIG. 4 is a sectional view of the locking member of FIG. 3, shown being released for movement to a weight supporting position.
Figure 5:
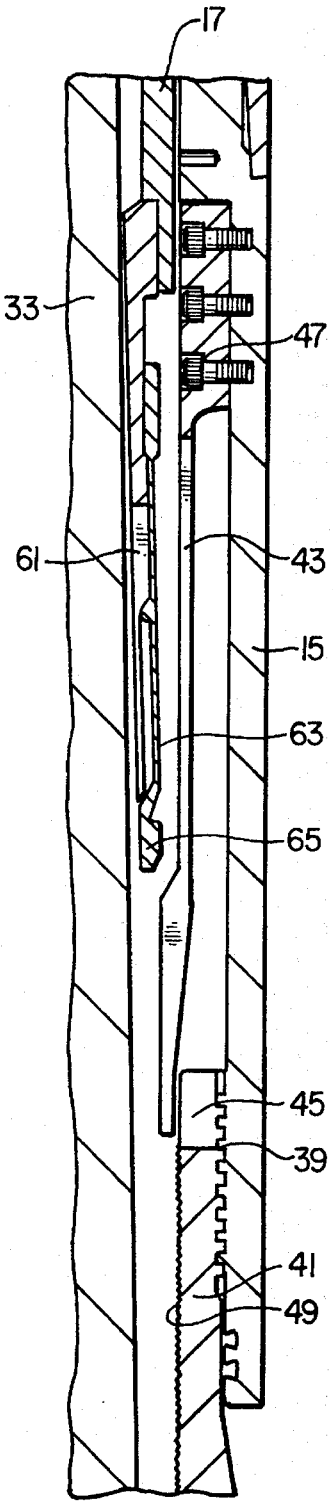
FIG. 5 is a partial quarter sectional view of a torque member which is part of the apparatus of FIGS. 1A–1C, and shown in a released position.

A lower chamber 25 is supplied with a lower hydraulic fluid passage 27, as shown also in FIG. 1B. A lower piston 29 formed on the exterior of barrel 15 forms a lower end of lower chamber 25. Supplying hydraulic fluid pressure to lower chamber 25 causes actuating sleeve 17 to move upward relative to barrel 15. FIGS. 1A, 1B and 1C show actuating sleeve 17 in the lower position, while FIGS. 4 and 5 show it in an upper position. FIG. 1B also shows surface wellhead housing 33, which is located at the well deck and connected to lower end of riser 11 by a wellhead connector 35. An internal shoulder 37 is located in the bore of surface wellhead housing 33 as shown in FIG. 1C. Although shown as a separate ring, internal shoulder 37 could also be integrally formed in surface wellhead housing 33.

Referring still to FIG. 1C, barrel 15 has a set of external threads 39 on its lower end which secure to mating threads within a mandrel 41. Mandrel 41 is part of a casing hanger and secures on its lower end to an upper string of casing 42 (FIG. 2) which extends downward from surface wellhead housing 33. A plurality of torque fingers 43 engage torque slots 45 formed on the upper exterior of mandrel 41. Each torque slot 45 is an axial recess circumferentially spaced from the other torque slots 45. Each torque finger 43 has a lower end which is biased outward by internal resiliency, and an upper end which is secured by fasteners 47 to barrel 15. As shown in FIG. 5, unless constrained, the lower end of each torque finger 43 will spring outward, disengaging itself from its torque slot 45. Actuating sleeve 17 will maintain torque fingers 43 in engagement with torque slot 45, as shown in FIG. 1C, until moved above torque fingers 43, shown in FIG. 5. When torque fingers 43 are in the engaged position, mandrel 41 will rotate in unison with running tool barrel 15 in the left-hand direction. When torque fingers 43 are in the released position, barrel 15 may be rotated in the opposite direction, which is noramlly a left-hand direction, relative to mandrel 41, unscrewing threads 39 from mandrel 41.

Figure 3:
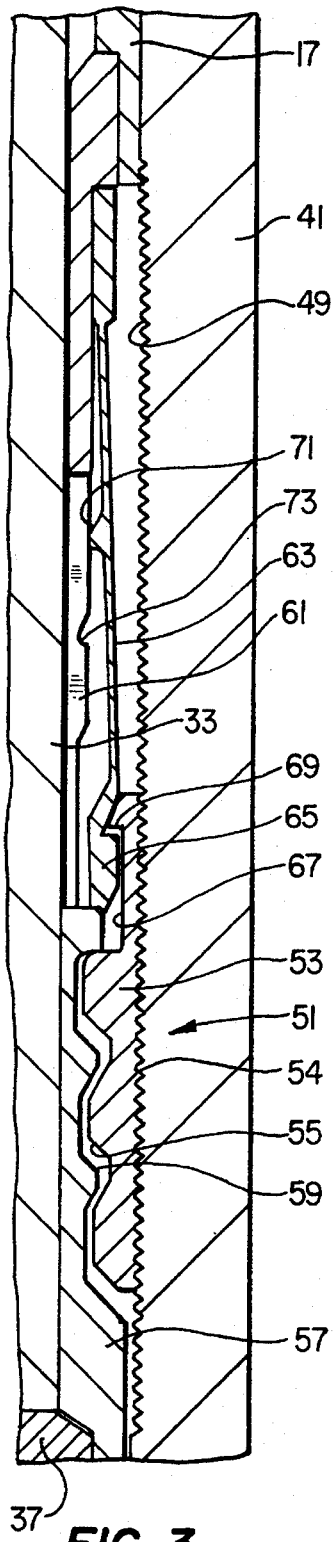
FIG. 3 is an enlarged partial quarter sectional view illustrating a locking member which is part of the apparatus of FIGS. 1A–1C, and shown in a cocked position.

Mandrel 41 has a plurality of external wickers or grooves 49, which in the preferred embodiment are a small triangular parallel grooves. A locking member 51 is carried on grooves 49. Referring to FIGS. 3 and 4, locking member 51 includes a ratchet ring 53. Ratchet ring 53 is an expansible member which can expand and contract radially on grooves 49. Ratchet ring 53 has an inner diameter with a plurality of parallel wickers or grooves 54 which will mate with the mandrel grooves 49. Ratchet ring 53 has plurality of load flanks 55 on its exterior, each being a downward and outward facing conical shoulder, much larger in dimension than the grooves 54. A load ring 57 locates on the exterior of ratchet ring 53. Load ring 57 is a solid nonexpansible ring, and has mating conical load flanks 59 in its interior which are upward and inward facing.

Actuating sleeve 17 has an extension sleeve 61 on its lower end which will contact the upper edge of load ring 57 to hold it in engagement with internal shoulder 37. The lower portion of extension sleeve 61 has vertical slots through it for flowby circulation. A collet 63 having a plurality of fingers 65 holds ratchet ring 53 in the cocked position shown in FIGS. 1C and 3. In the cocked position, ratchet ring 53 cannot move downward relative to load ring 57, and therefore cannot prevent mandrel 41 from moving either upward or downward relative to load ring 57. Each finger 65 will fit within a recess 67 formed on the upper end of ratchet ring 53. A downward facing hook or shoulder 69 at the upper end of recess 67 engages a mating recess in finger 65. The lower end of finger 65 contacts the upper end of load ring 57. The axial length of finger 65 is selected to maintain a clearance between flanks 55 and 59, preventing them from transferring any downward force on mandrel 41 to load ring 57. When finger 65 is allowed to spring outward from engagement with hook 69, as shown in FIG. 4, ratchet ring 53 is free to move downward so that load flanks 55 and 59 engage each other. When this occurs, the conical load flanks 55, 59 will cause the ratchet ring 53 to engage the mandrel grooves 54. In this weight supporting position (not shown), mandrel 41 will not be able to move downward relative to ratchet ring 53 and load ring 57.

Fingers 65 are maintained in engagement with recess 67 by the actuating sleeve extension 61. An external rib 71 formed on collet 63 contacts extension sleeve 61 to urge fingers 65 radially inward. Extension sleeve 61 has an internal recess 73 that will receive rib 71 when extension sleeve 61 is moved upward. When this occurs, the natural resiliency of collet 63 causes collet fingers 65 to spring outward as shown in FIG. 4. Continued upward movement of actuating sleeve 17 and extension sleeve 61 pulls collet 63 upward relative to locking member 51.

Figure 6:
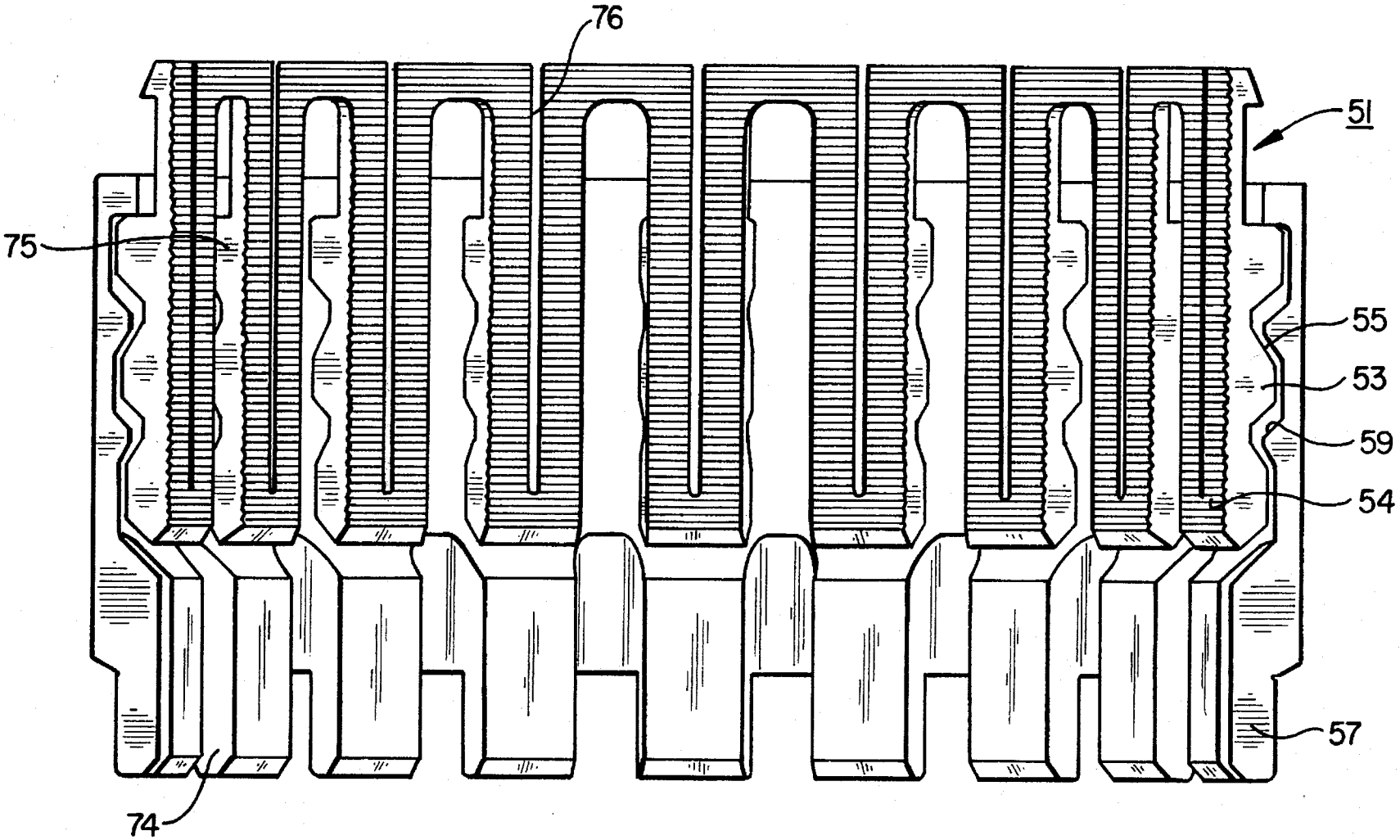
FIG. 6 is a perspective view of the locking member of FIGS. 3 and 4, shown laid out flat.

Referring to FIG. 6, locking member 51 has flowby means for allowing circulation after it has landed on internal shoulder 37. This comprises a plurality of axially spaced apart flow channels 74 formed in a lower portion of load ring 57. Channels 74 are located in the inner diameter of load ring 57, and do not extend completely through the radial thickness of load ring 74. Flow channels 74 extend from a lower end of load ring 74 upward to a bowl area which receives ratchet ring 53.

Ratchet ring 53 has a plurality of axially extending flow channels 75 which register with load ring flow channels 74. Flow channels 75 extend from the lower end upward to a selected point below the upper end of ratchet ring 75. The upper ends of ratchet ring flow channels 75 are above the upper end of load ring 57, for discharging flow above load ring 57. For radial expansion and contraction, a plurality of slits 76 extend from the upper edge of ratchet ring 53 downward to a selected point above the lower edge of ratchet ring 53. Slits 76, like flow channels 75, extend completely through the radial thickness of ratchet ring 53 from the inner diameter to the outer diameter. Each slit 76 alternates with one of the flow channels 75. Each slit 76 is considerably smaller in width than each flow channel 75. Slits 76 and flow channels 75 provide a serpentine configuration to ratchet ring 53.

Figure 2:
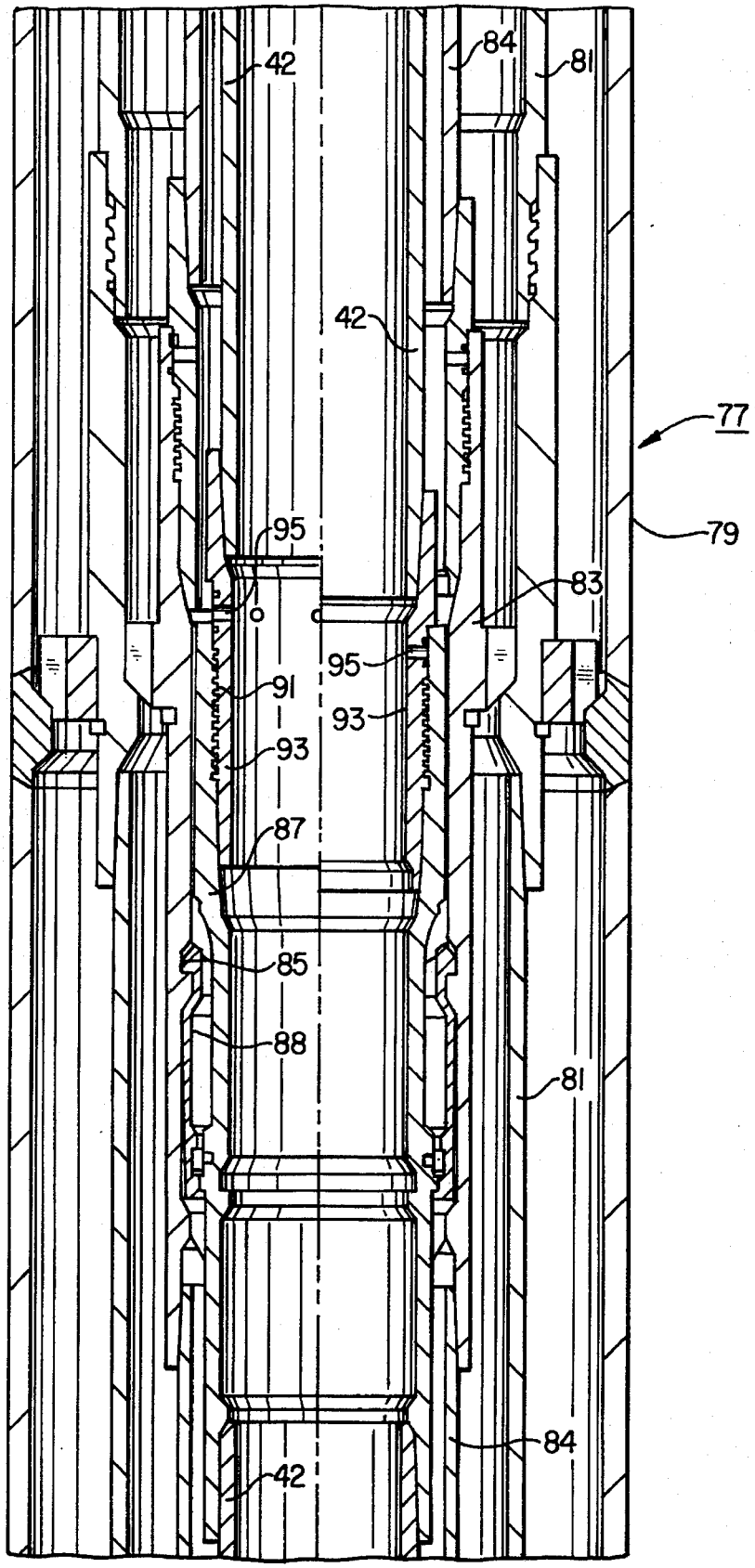
FIG. 2 is a partial vertical sectional view of a subsea wellhead assembly used with the apparatus of FIGS. 1A–1C. The left side of the drawing shows the apparatus in one position, while the right side shows the apparatus in another position.

Referring to FIG. 2, subsea wellhead assembly 77 include a string of outer conductor pipe 79, normally 30 inches in diameter. Conductor pipe 79 will extend from a first depth in the well to the surface wellhead housing 33 (FIG. 1C). An outer string of casing 81, typically 20 inches in diameter, will extend to a second depth in the well, with outer casing 81 being supported by a ring in conductor pipe 79. An upper string of outer casing 81 will also extend to the surface wellhead housing 33. An intermediate string of casing 84, supported by a mudline casing hanger 83, extends to third depth in the well, and also to the surface wellhead housing 33. Intermediate casing string 84 is typically 13⅜ inch in diameter. Intermediate mudline casing hanger 83 lands on a load ring in outer casing 81. Intermediate casing hanger 83 has a mudline profile 85 in its interior.

The lower string of inner casing 42, which is typically 9⅞ inches in diameter, is supported by a mudline casing hanger 87. Casing hanger 87 has a latch 88 on its exterior that engages mudline profile 85. Casing hanger 87 has a set of threads 91 on its upper end which are engaged by a lower running tool 93. Lower running tool 93 has a plurality of wash ports 95 that extend through its sidewall. When threads 91 are fully tightened, wash ports 95 will be in a closed position, as shown on the left side of FIG. 2. When lower running tool 93 is rotated in a left-hand direction, to unscrew it at least partially, wash ports 95 will be exposed, communicating the interior of casing string 42 with its annulus. This position is shown in the right side of FIG. 2. A similar smaller diameter string of casing (not shown) may be installed within the well within inner casing 42. Furthermore, although not specifically described, the intermediate casing 84 has similar wash ports and a similar lower running tool. Intermediate casing 84 may be installed and tensioned in the same manner as inner casing 42.

In operation, the jackup drilling rig will install the conductor pipe 79 and outer casing 81 (FIG. 2) in a conventional matter. Similarly, surface wellhead housing 33 will be installed at the drilling rig in a conventional matter, supported on the conductor pipe 79 (FIG. 2). Intermediate casing hanger 83 and intermediate casing 84 will be installed. The operator will install inner casing 42 by first making up the lower string of inner casing 42 with casing hanger 87 on its upper end. Lower running tool 93 will be secured to casing hanger 87 and to the lower end of the upper string of inner casing 42. Mandrel 41 is secured to the upper end of the upper string of inner casing 42. Barrel 15 of upper running tool 13 is secured to the upper end of mandrel 41. As shown in FIG. 1C, locking member 51 is positioned on mandrel 41 in a lower position at the lower end of grooves 49.

The entire assembly is then lowered into the well. Hydraulic fluid pressure is provided to upper chamber 21 (FIG. 1A) to maintain a downward force of extension sleeve 61 on load ring 57. Torque fingers 43 will be in the engaged position shown in FIG. 1C. Locking member 51 will be in the cocked position shown in FIG. 1C.

When the load ring 57 reaches the internal shoulder 37, shown in FIG. 1C, the casing hanger 87 (FIG. 2) will still be located above its profile 85 by short distance. At this point, the operator will relieve the pressure in upper chamber 21 (FIG. 1) and continue lowering barrel 15. Actuating sleeve 17 will remain stationary as barrel 15 moves downward relative to locking member 51. Ratchet ring 53 will ratchet on grooves 49 but will not prevent the downward movement of mandrel 41. This position is shown on the right side of FIG 1C. Referring to FIG. 2, mudline latch 88 will latch into profile 85. The operator will then pump cement down the casing string 42. The cement will flow back up the annulus surrounding the lower string of inner casing 42. Returns caused by the cementing will flow upward in the annulus surrounding the upper string of inner casing 42, through the flow channels 74 and 75 (FIG. 6) and up the annulus surrounding the upper running tool 13.

After cementing has been completed, the washout operation is performed. During this operation, conduit 12 (FIG. 1A) and the barrel 15 of upper running tool 13 are rotated to the left. This left-hand rotation transmits through torque fingers 43 to the upper string of inner casing 42 and to the lower running tool 93. This unscrews lower running tool 93 sufficiently for opening washout ports 95, illustrated by the left side of FIG. 2. The operator pumps fluid down inner casing 42, through wash ports 95, with circulation returns flowing up the annulus surrounding the upper string of inner casing 42. The flowby flows through the flow channels 74, 75 (FIG. 6) of the locking member 51. Once this is completed, the operator rotates conduit 12 and barrel 15 of upper running tool 13 to the right to retighten lower running tool 93 to casing hanger 87, shown in the right side of FIG. 2.

Then, the operator will provide hydraulic pressure again to the upper chamber 21 (FIG. 1A) to maintain a downward force on load ring 57 (FIG. 1C). The operator begins picking up conduit 12 and barrel 15 of upper running tool 13, while actuating sleeve 17 remains stationary. Collet fingers 65 will continue to hold locking member 51 in the cocked position during this occurrence. Ratchet ring 53 ratchets on grooves 49. Once the desired pull has been achieved, the operator relieves the hydraulic fluid pressure in upper chamber 21 and supplies it to lower chamber 25 (FIG. 1B). The operator continues to maintain pull on barrel 15. Actuating sleeve 17 will move upward relative to mandrel 41, as shown in FIG. 4. The collet fingers 65 will release from engagement with the ratchet ring 53 and move upward above locking member 51, as shown in FIG. 5. Once collet finger 65 are above the lower ends of torque finger 43, torque fingers 43 will move to the released position.

The operator can then slack off the pull on barrel 15. The locking member 51 will now support the mandrel 41 and the upper string of casing 42 in tension. The operator then rotates the barrel 15 to the left, unscrewing the running tool barrel 15 from mandrel 41. The operator then retrieves the running tool 13, bringing along with it the collet 63.

The invention has significant advantages. The torque fingers allow the lower running tool to be rotated to expose wash ports in a left-hand rotation even though the locking member has already been located on the surface wellhead housing internal shoulder. The actuating sleeve of the running tool keeps the torque fingers in engagement with the torque slots until the actuating sleeve has moved upward, which occurs after the washout operation has been completed. The flow channels through the locking member enable circulation to take place for cementing and washout even though the locking member is installed on the internal shoulder prior to these operations.

While the invention has been shown in only one of its forms, it should be apparent to those skilled in the art that it is not so limited, but is susceptible to various changes without departing from the scope of the invention.

I claim:

1. In an offshore well having a subsea wellhead assembly which has a mudline profile, a lower casing string extending into the well and having a casing hanger on its upper end which lands in the mudline profile, a lower running tool connected to the casing hanger and lowered on an upper casing string from a drilling rig, a wash port at the casing hanger which is shifted from a closed position to an open position by rotation of the lower running tool to clean an annulus surrounding the upper casing string after cementing the lower casing string, a surface wellhead assembly on the drilling rig having an internal shoulder for supporting the upper casing string in tension, the improvement comprising:

an upper running tool;

a mandrel secured by threads to the upper running tool and connected into the upper casing string;

a locking member carried on the mandrel which lands on the internal shoulder as the upper string is lowered by the upper running tool through the surface wellhead assembly, the locking member having a cocked position which allows further downward movement of the mandrel relative to the locking member after the locking member has landed to land the casing hanger in the profile;

an actuating member carried by the upper running tool which holds the locking member in the cocked position;

a plurality of torque slots formed on an exterior portion of the mandrel;

a plurality of torque fingers mounted to the upper running tool for engaging the torque slots to transmit rotation of the upper running tool to the upper casing string to shift the wash port to the open position;

the actuating member being upwardly movable relative to the mandrel to release the locking member to move to the weight supporting position to support the upper casing string on the internal shoulder after the wash port has been shifted back to the closed position and tension has been applied to the upper casing string; and the torque fingers being movable from the torque slots in response to the upward movement of the actuating member to allow the upper running tool to be unscrewed from the mandrel after the upper casing string is supported in tension by the locking member.

2. The offshore well according to claim 1, further comprising:

a plurality of flow passages in the locking member to allow circulation up the annulus surrounding the upper casing string.

3. The offshore well according to claim 1, wherein:

the torque fingers have lower ends which move radially into and out of engagement with the torque slots; and the actuating member moves upward relative to the torque fingers to allow the radial outward movement of the torque fingers.

4. The offshore well according to claim 1, wherein:

the torque fingers have lower ends which move radially into and out of engagement with the torque slots; and the actuating member extends around the torque fingers to prevent the outward movement of the torque fingers until the actuating member is moved above the lower ends of the torque fingers.

5. The offshore well according to claim 1, wherein the locking member comprises:

an inner member carried by an outer member which lands on the internal shoulder, the inner member having gripping means for gripping the mandrel when the inner member is allowed to move from the cocked position to the weight supporting position relative to the outer member;

at least one outer member flow channel formed in the outer member; and a plurality of inner member flow channels spaced around the inner member, each of which has a lower end which communicates with the outer member flow channel to allow circulation of fluid up the annulus surrounding the upper casing string.

6. The offshore well according to claim 1, wherein the mandrel has a plurality of grooves on its exterior, and the locking member comprises:

a ratchet ring having an inner diameter containing a set of grooves for mating with the grooves on the mandrel, the ratchet ring having an exterior containing a plurality of inclined load flanks;

a load ring which lands on the internal shoulder, the load ring having an interior containing a plurality of load flanks that mate with the load flanks of the ratchet ring, the ratchet ring being radially expansible so as to radially expand and contract to ratchet on the grooves of the mandrel while in the cocked position, and wherein while in the weight supporting position, the load flanks of the ratchet ring and the load ring support the upper casing string on the internal shoulder in tension; and a plurality of axially extending load ring flow channels spaced around a lower portion of the load ring; and a plurality of axially extending ratchet ring flow channels which have lower ends which communicate with the load ring flow channels to allow circulation of fluid up the annulus surrounding the upper casing string.

7. In an offshore well having a subsea wellhead assembly which has a mudline profile, a lower casing string extending into the well and having a casing hanger on its upper end which lands in the mudline profile and has a set of internal threads, a lower running tool secured to the threads of the casing hanger and lowered on an upper casing string from a drilling rig, a wash port at the casing hanger which is shifted from a closed position to an open position by at least partially unscrewing the lower running tool from the casing hanger to clean an annulus surrounding the upper casing string after cementing the lower casing string, a surface wellhead assembly on the drilling rig having an internal shoulder for supporting the upper casing string in tension, the improvement comprising:

an upper running tool;

a mandrel secured by threads to the upper running tool and connected to the upper casing string and having exterior grooves;

a ratchet ring having an inner diameter containing a set of grooves for mating with the grooves on the mandrel, the ratchet ring having an exterior containing a plurality of inclined load flanks;

a load ring having an external shoulder which lands on the internal shoulder as the upper running tool lowers the upper string through the surface wellhead assembly, the load ring having an interior containing a plurality of load flanks that mate with the load flanks of the ratchet ring;

an actuating member which holds the ratchet ring in a cocked position while the upper running tool lowers the upper and lower casing strings into the well, the cocked position allowing further downward movement of the mandrel relative to the load ring after the load ring has landed to land the casing hanger in the profile;

a plurality of torque slots formed on an exterior portion of the mandrel;

a plurality of torque fingers mounted to the upper running tool for engaging the torque slots to transmit rotation of the upper running tool to the upper casing string to at least partially unscrew the lower running tool from the casing hanger to shift the wash ports to the open position;

a plurality of axially extending load ring flow channels spaced around a lower portion of the load ring;

a plurality of axially extending ratchet ring flow channels which have lower ends which communicate with the load ring flow channels to allow circulation of fluid up the annulus surrounding the upper casing string while the load ring is supported on the internal shoulder;

the actuating member being upwardly movable relative to the mandrel to release the ratchet ring to move to a weight supporting position wherein the load flanks of the ratchet ring and the load ring support the upper casing string on the internal shoulder in tension after the wash ports have been shifted back to the closed position and tension to the upper casing string has been applied; and the torque fingers being movable from the torque slots in response to the upward movement of the actuating member to allow the upper running tool to be unscrewed from the mandrel after the upper casing string is supported in tension by the load ring.

8. The offshore well according to claim 7, wherein:

the torque fingers have lower ends which move radially into and out of engagement with the torque slots; and the actuating member moves upward relative to the torque fingers to allow the radial outward movement of the torque fingers.

9. The offshore well according to claim 7, wherein:

the torque fingers have lower ends which move radially into and out of engagement with the torque slots; and the actuating member extends around the torque fingers to prevent the outward movement of the torque fingers until the actuating member is moved above the lower ends of the torque fingers.

10. The offshore well according to claim 7, wherein:

the load ring flow channels are located on an inner diameter of the lower portion of the load ring so as to allow flow between the mandrel and the load ring.

11. The offshore well according to claim 7, wherein:

the ratchet ring flow channels extend from an inner diameter of the ratchet ring through the load flanks of the ratchet ring.

12. The offshore well according to claim 7, wherein:

the ratchet ring flow channels extend above an upper edge of the load ring.

13. The offshore well according to claim 7, wherein:

the ratchet ring has a plurality of slits which extend from an upper edge to a selected point above a lower edge of the ratchet ring to facilitate radial expansion and contraction; and the ratchet ring flow channels alternate with the slits and extend from the lower edge to a selected point below the upper edge.

14. In an offshore well having a subsea wellhead assembly, a surface wellhead assembly having an internal shoulder for supporting an upper casing string extending between the subsea wellhead assembly and the surface wellhead assembly, the improvement comprising:

a mandrel connected into the upper casing string;

a locking member carried on the mandrel;

running tool means for lowering the upper casing string through the surface wellhead assembly, for engaging a lower end of the upper casing string with the subsea wellhead assembly, for applying tension to the upper casing string, and for landing the locking member on the internal shoulder to support the upper casing string in tension; and a plurality of flow passages in the locking member to allow circulation up an annulus surrounding the upper casing string after the locking member has landed on the internal shoulder.

15. The offshore well according to claim 14, wherein the locking member comprises:

an outer member which lands on the internal shoulder;

an inner member carried by the outer member, the inner member having gripping means for gripping the mandrel to prevent downward movement of the mandrel relative to the inner member when in a weight supporting position; and wherein the flow passages comprise:

at least one outer member flow channel formed in the outer member; and a plurality of inner member flow channels spaced around the inner member, each of which has a lower end which communicates with the outer member flow channel.

16. The offshore well according to claim 14, wherein the mandrel has a plurality of grooves on its exterior, and the locking member comprises:

a ratchet ring having an inner diameter containing a set of grooves for mating with the grooves on the mandrel, the ratchet ring having an exterior containing a plurality of inclined load flanks;

a load ring which lands on the internal shoulder, the load ring having an interior containing a plurality of load flanks that mate with the load flanks of the ratchet ring, the ratchet ring being radially expansible, and while in a weight supporting position, the load flanks of the ratchet ring and the load ring supporting the upper casing string on the internal shoulder in tension; and wherein the flow passages comprises:

a plurality of axially extending load ring flow channels spaced around a lower portion of the load ring; and a plurality of axially extending ratchet ring flow channels which have lower ends which communicate with the load ring flow channels.

17. A locking member for supporting on an internal shoulder of a surface wellhead assembly an upper casing string extending between a subsea wellhead assembly and the surface wellhead assembly, comprising:

a ratchet ring having an inner diameter containing a set of grooves for gripping the upper casing string, the ratchet ring having an exterior containing a plurality of inclined load flanks;

a load ring which lands on the internal shoulder, the load ring having an interior containing a plurality of load flanks that mate with the load flanks of the ratchet ring, the ratchet ring being radially expansible to allow axial relative movement between the upper casing string and the ratchet ring, and while in a weight supporting position, the load flanks of the ratchet ring and the load ring supporting the upper casing string on the internal shoulder in tension; and a plurality of axially extending load ring flow channels spaced around a lower portion of the load ring; and a plurality of axially extending ratchet ring flow channels which have lower ends which communicate with the load ring flow channels to allow circulation of fluid up an annulus surrounding the upper casing string after the load ring has landed on the internal shoulder.

18. The locking member according to claim 17, wherein:

the load ring flow channels are located on an inner diameter of the lower portion of the load ring so as to allow flow between the mandrel and the load ring.

19. The locking member according to claim 17, wherein:

the ratchet ring flow channels extend from an inner diameter of the ratchet ring through the load flanks of the ratchet ring.

20. The locking member according to claim 17, wherein:

the ratchet ring flow channels extend above an upper edge of the load ring.

21. The locking member according to claim 17, wherein:

the ratchet ring has a plurality of slits which extend from an upper edge to a selected point above a lower edge of the ratchet ring to facilitate radial expansion; and the ratchet ring flow channels alternate with the slits and extend from the lower edge to a selected point below the upper edge of the ratchet ring.

22. A method of installing casing in offshore well having a subsea wellhead assembly which has a mudline profile and a surface wellhead assembly having an internal shoulder, comprising:

making up a lower casing string with a casing hanger on its upper end;

securing a lower running tool to the casing hanger and providing a wash port at the casing hanger which is shiftable from a closed position to an open position by rotation of the lower running tool relative to the casing hanger;

securing a lower end of an upper casing string to the lower running tool;

providing a mandrel and a locking member on the mandrel which has a cocked position which allows upward and downward movement of the mandrel relative to the locking member, and which has a weight supporting position which prevents downward movement of the mandrel relative to the locking member;

connecting the mandrel to the upper end of the upper casing string;

screwing an upper running tool to the mandrel and providing the upper running tool with an actuating member which releasable holds the locking member in the cocked position;

providing the upper running tool and mandrel with a torque member which has a locked position which causes the mandrel to rotate with the upper running tool in both right-hand and left-hand directions, and which has a released position which allows the upper running tool to be unscrewed from the mandrel by rotation of the upper running tool relative to the mandrel in one of the directions;

with the upper running tool, lowering the casing strings in the well, causing the locking member to land on the internal shoulder, and while maintaining the locking member in the cocked position, continuing to lower the casing strings until the casing hanger lands in the profile; then cementing the lower casing string in the well; then rotating the upper running tool in one of the directions while the torque transmitter is in the locked position to shift the wash port to the open position; then circulating fluid down the upper casing string and through the wash port; then rotating the upper running tool in the other of the directions to shift the wash port back to the closed position; then applying tension to the upper casing string by pulling the running tool upward while holding the locking member on the internal shoulder with the actuating member; then moving the actuating member upward relative to the mandrel to release the locking member to move to the weight supporting position, and relaxing the pull on the upper running tool, causing the locking member to support the upper casing string in tension on the internal shoulder; and moving the torque member to the released position and unscrewing the upper running tool from the mandrel.

23. The method according to claim 22, further comprising:

flowing fluid up an annulus surrounding the upper casing string and through flow passages provided in the lock member while cementing and while circulating fluid down the upper casing string through the wash port.

24. The method according to claim 22, wherein the torque member moves to the released position in response to the upward movement of the actuating member.

* * * * *